US006877244B2

(12) United States Patent
Rapport

(10) Patent No.: US 6,877,244 B2
(45) Date of Patent: Apr. 12, 2005

(54) DEVICE AND METHOD FOR PHOTOGRAPHIC IMAGE REDUCTION AND SIZE STANDARDIZATION

(75) Inventor: Abbie Rapport, Northridge, CA (US)

(73) Assignee: Broadway Entertainment, Inc., Santa Monica, CA (US)

( * ) Notice: Subject to any disclaimer, the term of this patent is extended or adjusted under 35 U.S.C. 154(b) by 0 days.

(21) Appl. No.: 10/439,026

(22) Filed: May 14, 2003

(65) Prior Publication Data

US 2004/0226182 A1 Nov. 18, 2004

(51) Int. Cl.[7] ..... B43L 13/20
(52) U.S. Cl. ..... 33/563
(58) Field of Search ..... 33/562, 563, 566, 33/1 G; 355/133, 2

(56) References Cited

U.S. PATENT DOCUMENTS 3,124,997 A * 3/1964 Morton ..... 33/563
5,174,031 A * 12/1992 Davis ..... 33/1 B
RE34,374 E * 9/1993 Davidson ..... 33/566
5,347,724 A * 9/1994 Hankins ..... 33/563
6,418,635 B1 * 7/2002 Nelson et al. ..... 33/563

* cited by examiner

*Primary Examiner*—Christopher W. Fulton
(74) *Attorney, Agent, or Firm*—Rapkin, Gitlin & Beaumont

(57) ABSTRACT

A device employed in the reduction and standardization of the sizes of visual works, such as photographic images, for use with articles of jewelry, such as a bracelet. Included is a template comprised of a rectangular sheet of material having a plurality of different size openings defined by borders adapted to overlay the version of a visual work with the largest image to overlying progressively smaller cropped versions of the work. Means are combined with the overlayed visual works to standardize their sizes and enable them to be assembled and integrated with items of jewelry having miniature frames. A method to employ the device of the present invention for reducing, cropping and standardizing the sizes of the visual works for use with articles of jewelry.

6 Claims, 6 Drawing Sheets

FIG. 2A
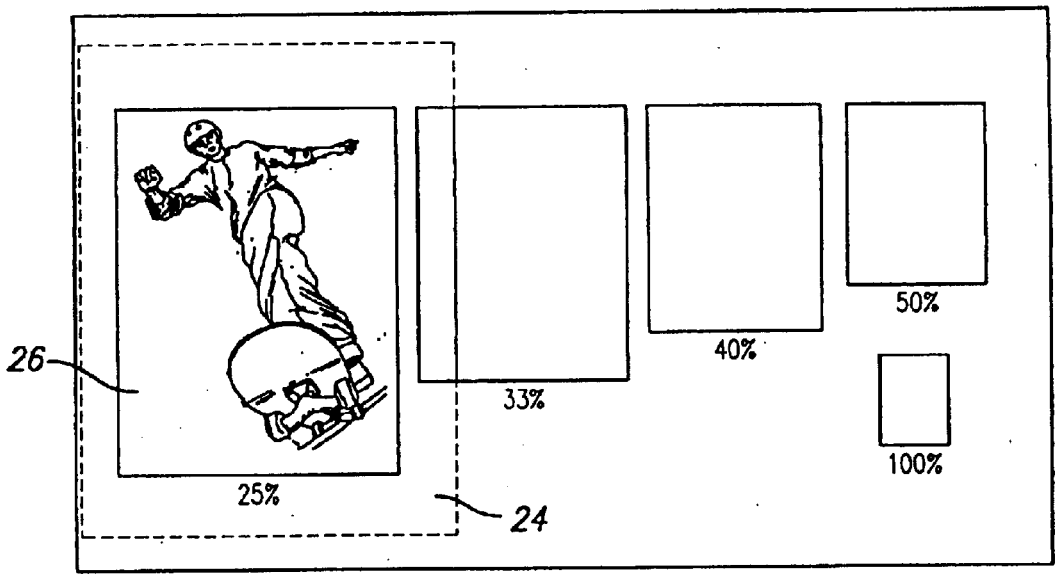
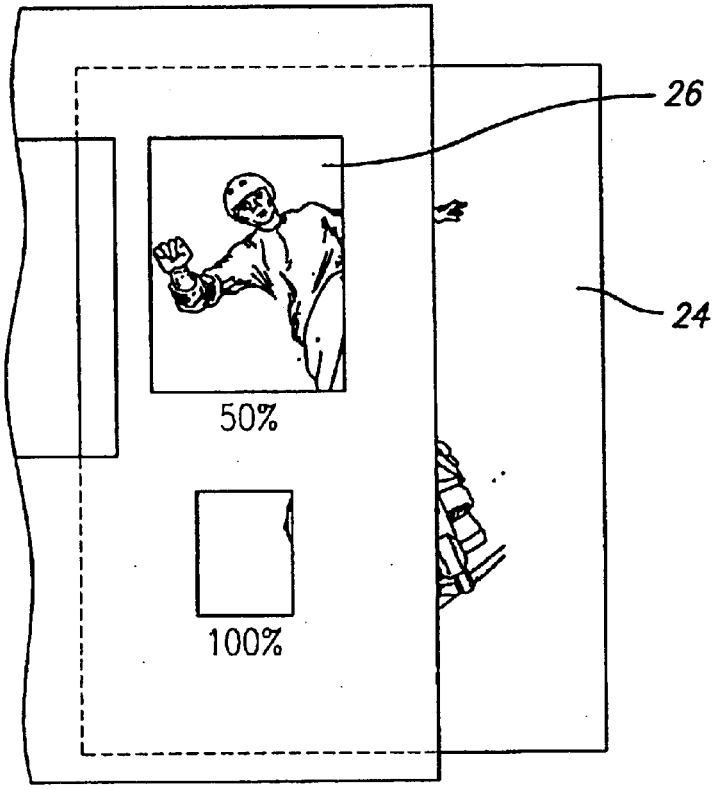
FIG. 2B

FIG. 3
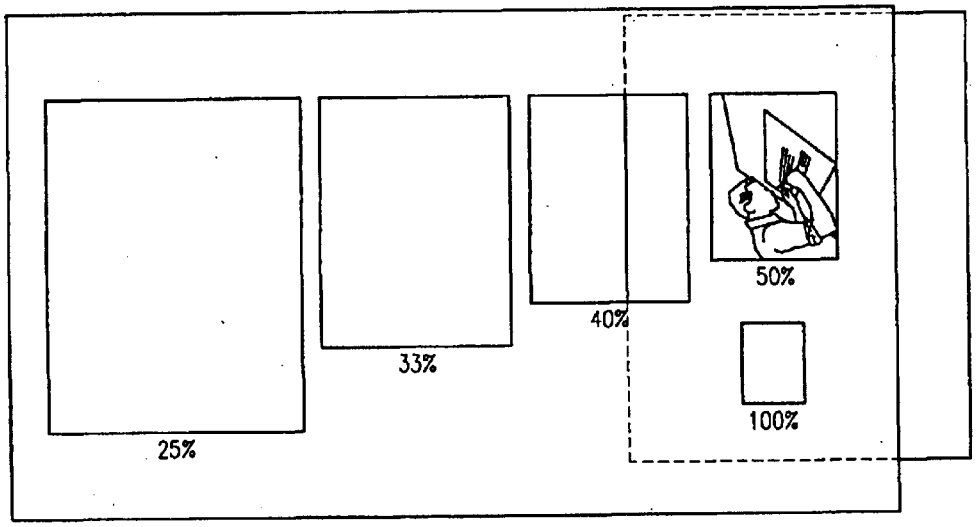
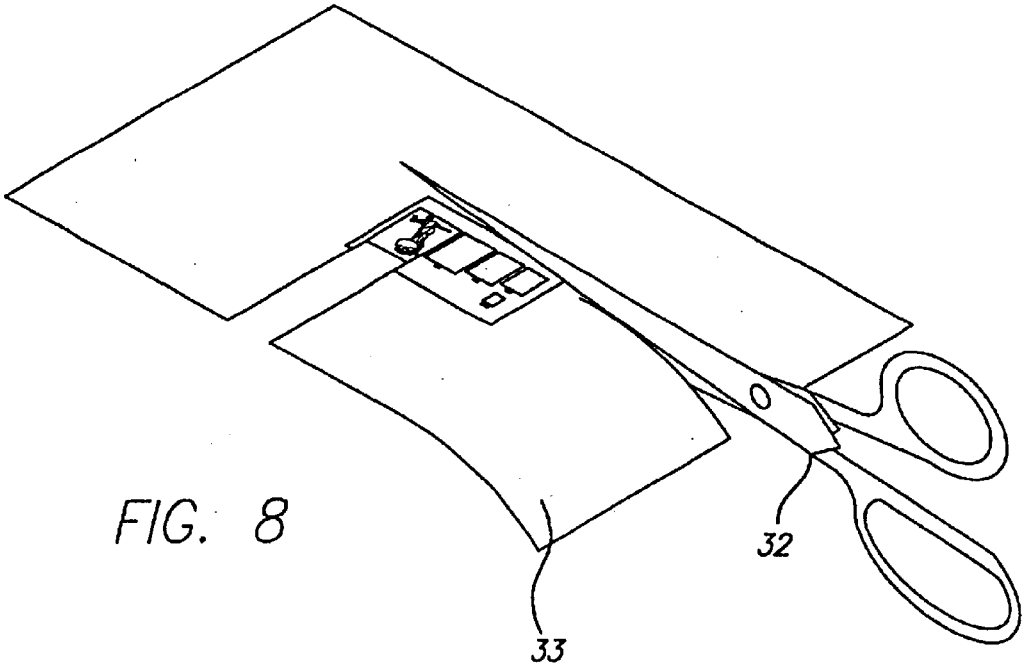
FIG. 8

DEVICE AND METHOD FOR PHOTOGRAPHIC IMAGE REDUCTION AND SIZE STANDARDIZATION

BACKGROUND OF THE INVENTION

1. Field of the Invention

The present invention relates generally to the field of cropping images and, more particularly to a device employed in the cropping and reduction of visual works for use with articles of jewelry and the method for cropping and reducing the images of visual works.

2. Description of the Prior Art

The art of cropping images or reducing the focus of an image to a specific portion of the larger parent image is well known in the prior art, particularly in the field of photography.

Included among this prior art are the devices and methods shown and described in U.S. Pat. No. 5,174,031 issued Dec. 29, 1992 to Davis; U.S. Pat. No. 2,018,542 issued Oct. 22, 1935 to Boughton; U.S. Pat. No. 5,534,971 issued Jul. 9, 1996 to Gaetano and U.S. Pat. No. 4,132,480 issued Jan. 2, 1979 to Reed.

Davis is directed to a proportional cropping template for film, contacts, or prints designed with various cutouts and having demarcations to give depth measurements when selected images are enlarged to a specific width size. One of a set of twelve master templates allows a user to slide or overlay it across the contact negative or print to find a cutout size that crops or masks an image to include the most pleasing composition whereby it is then traced. The inch marks along the sides of the template cutout are read so that the user is able to determine the depth size of a completed cropped print.

Boughton is directed to a set or series of photographic masks for use in preparing negatives for the making of enlarged prints from selected portions of the negatives. Each window on the mask is numbered in accordance with the degree of enlarging necessary to project a given size print. A part of a negative which is desired to project is located over the window of a selected mask and the negative is fastened to the mask by the use of gummed fasteners.

Gaetano is directed to a masking guide that includes a plurality of masking frames of different dimensions positioned concentrically within one another in a nested arrangement for selectively composing the content of a photograph. The masking frame provides a range of progressively decreasing print areas so that when it is positioned over a proof, the composition of the proof is viewable through the base frame and the hinged apertures can be positioned up out of the way or down over the proof until the desired inner frame is determined. To correspond with the selection, the negative is mounted on a crop card or mounting card that corresponds with the selected frame of the masking guide. Prints made from the negative with the crop card will have a composition as selected using the masking frame.

Reed is directed to a photographic cropping mask having prescored, detachable rectilinear openings with a common center. Also provided are indexing means and an optional adhesive material and/or crop marks to enable the mask to be positioned adjacent a transparent film to determine the cropping opening appropriate to the film image. The selected opening is produced by detaching it along an appropriate score line.

Other cropping devices and methods, such as those disclosed in U.S. Pat. Nos. 6,177,982B1 and 6,505,858B1, are also known in the prior art.

Neither the aforesaid references nor anything else known to applicant in the prior art discloses the improvements of the present invention directed to a device, and the method of employing same, used in the cropping and reduction of a photographic image or the like for use with articles of jewelry, comprising a rectangular sheet of material having a plurality of different size openings for overlaying an image and progressively smaller cropped versions thereof and a means combined with the overlayed image to standardize the sizes or dimensions of the images to assemble and integrate the images and the jewelry.

SUMMARY OF THE INVENTION

In its preferred embodiment the present invention provides a device employed in the reduction and standardization of the sizes of visual works, such as photographic images, for use with articles of jewelry, such as a bracelet, a necklace, or the like. Included is a template comprised of a rectangular sheet of material having a plurality of different size openings defined by borders adapted to overlay the version of a visual work with the largest image to overlying progressively smaller cropped images of the work. Means are combined with the overlayed visual works to standardize their sizes and enable them to be assembled and integrated with articles of jewelry with miniature frames. Also provided is the method for reducing, cropping and standardizing the images of visual works.

Accordingly, it is an object of the present invention to provide an improved device for reducing the images of visual works for use with articles of jewelry with miniature frames.

Another object of the present invention is to provide an improved device for standardizing the sizes of images of visual works for use in combination with articles of jewelry with miniature frames.

Still another object of the present invention is to provide an improved device capable of overlaying the largest version of a particular image of a visual work and overlaying progressively smaller cropped versions of the visual work to standardize their sizes for use with articles of jewelry with miniature frames.

Still another object of the present invention is to provide an improved device that combines with a conventional photocopy machine with reduction capability to standardize the sizes of the images of a visual work for use with articles of jewelry with miniature frames.

Still another object of the present invention is to provide an improved device that includes templates with different size openings corresponding individually to a predetermined reduction setting in a photocopy machine.

Still another object of the present invention is to provide an improved method of employing a device having a plurality of different size openings for use with a conventional photocopy machine to reduce and standardize the images of a visual work for use with articles of jewelry with miniature frames.

Still another object of the present invention is to provide an improved device that is easy and cost effective to manufacture.

Still another object of the present invention is to provide an improved method that is easy to employ.

Other objects and advantages of the present invention will become apparent in the following specifications when considered in light of the attached drawings wherein the preferred embodiment of the invention is illustrated.

BRIEF DESCRIPTION OF THE DRAWINGS

FIG. 2A is a diagrammatic view illustrating the device and method of the present invention employed in cropping a sample photograph showing the 25% setting of the template corresponding to the 25% zoom or reduction setting of a photocopy machine.

FIG. 2B is a diagrammatic view illustrating the device and method of the present invention employed in further cropping the same sample photograph showing the 50% setting of the template corresponding to the 50% zoom or reduction setting of a photocopy machine.

FIG. 3 is a diagrammatic view illustrating the device and method of the present invention employed in cropping a second sample photograph showing the 50% setting of the template corresponding to the 50% zoom or reduction setting of a photocopy machine.

FIG. 8 is a diagrammatic view illustrating a photographic image being cut from the photocopy paper to enable it to fit inside a miniature frame.

DETAILED DESCRIPTION OF THE PREFERRED EMBODIMENT

Figure 1A:
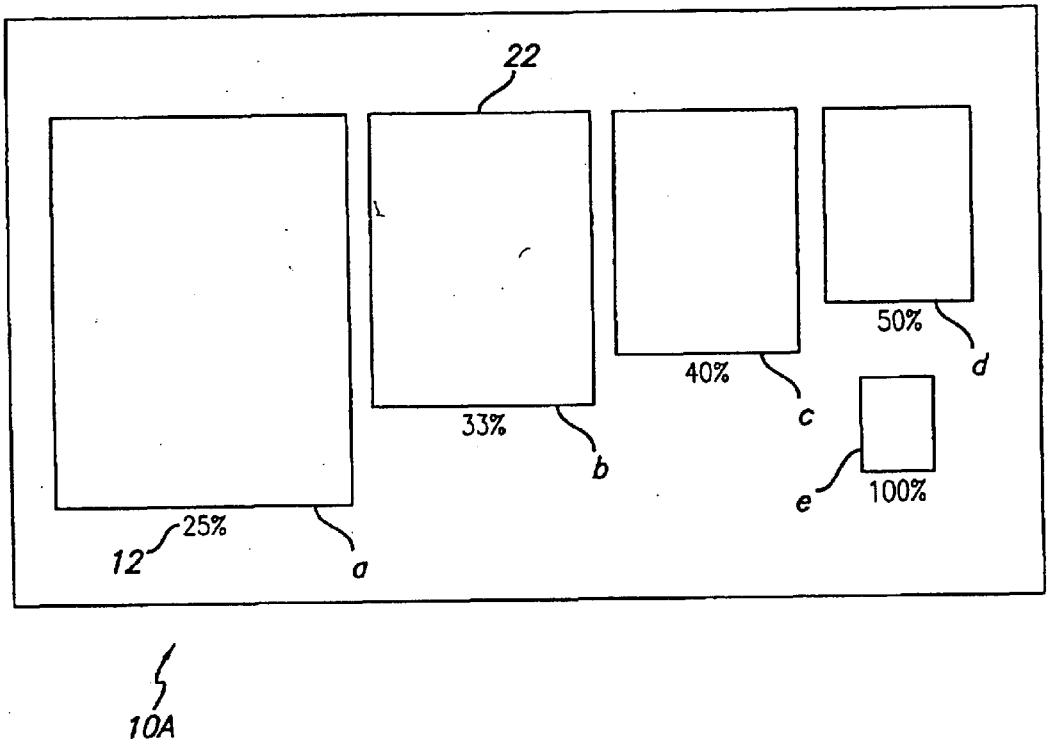
FIG. 1A is a perspective view of a group of vertically oriented templates made in accordance with the present invention.
Figure 1B:
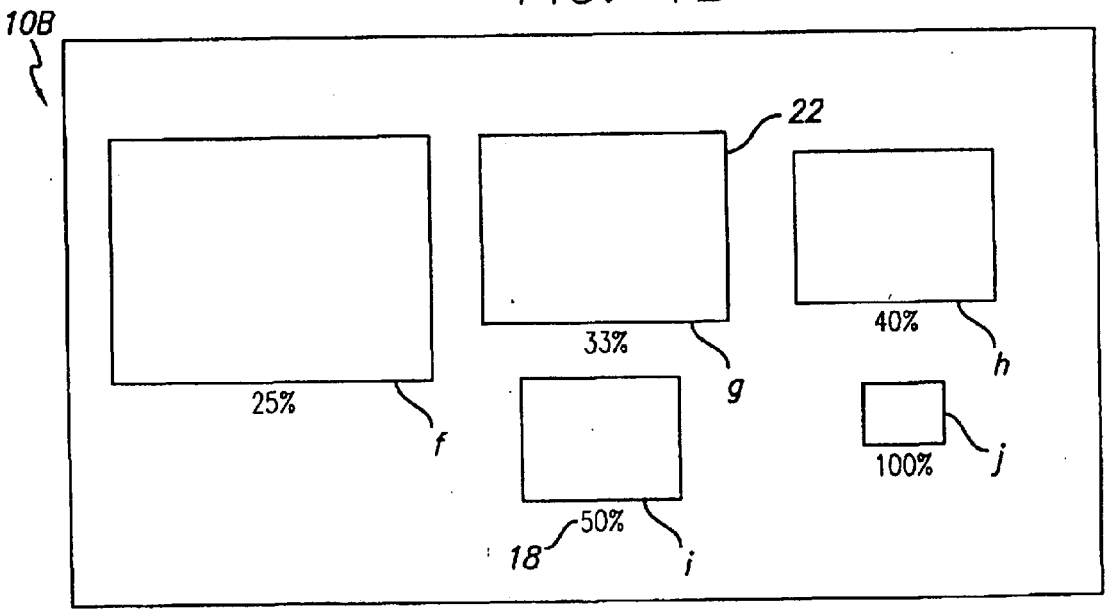
FIG. 1B is a perspective view of a group of horizontally oriented templates made in accordance with the present invention.
Figure 4:
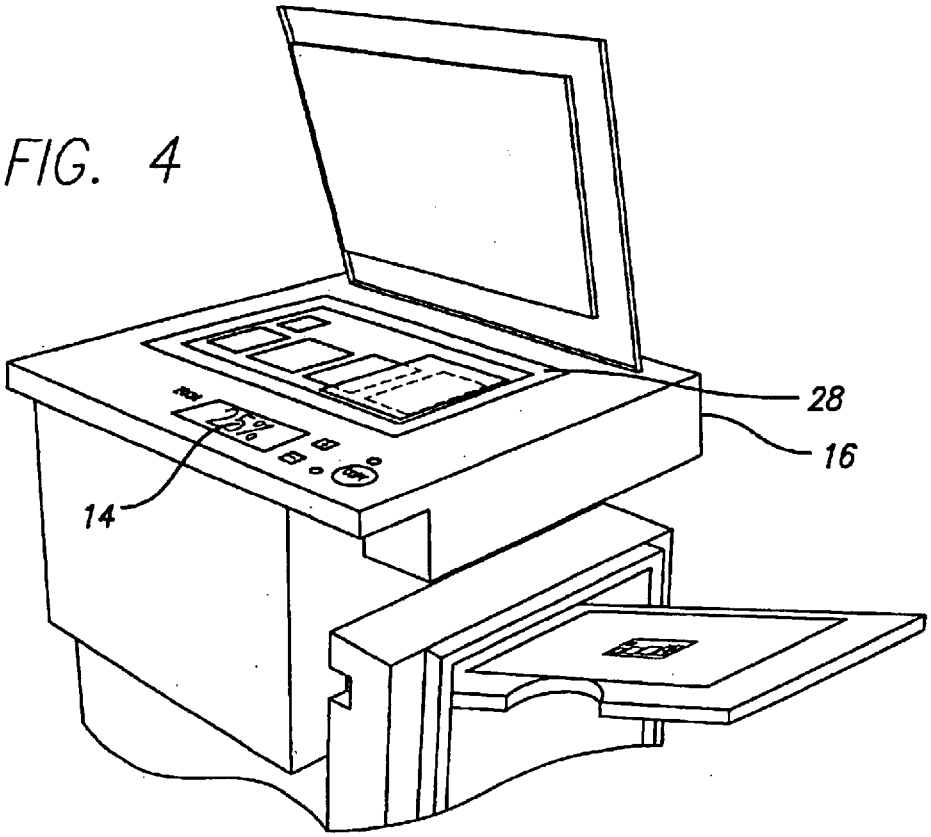
FIG. 4 is a diagrammatic view illustrating the device and method of the present invention employed in placing a cropped photograph on the photocopy machine set to the 25% zoom or reduction setting corresponding to the 25%% setting of the template.
Figure 5:
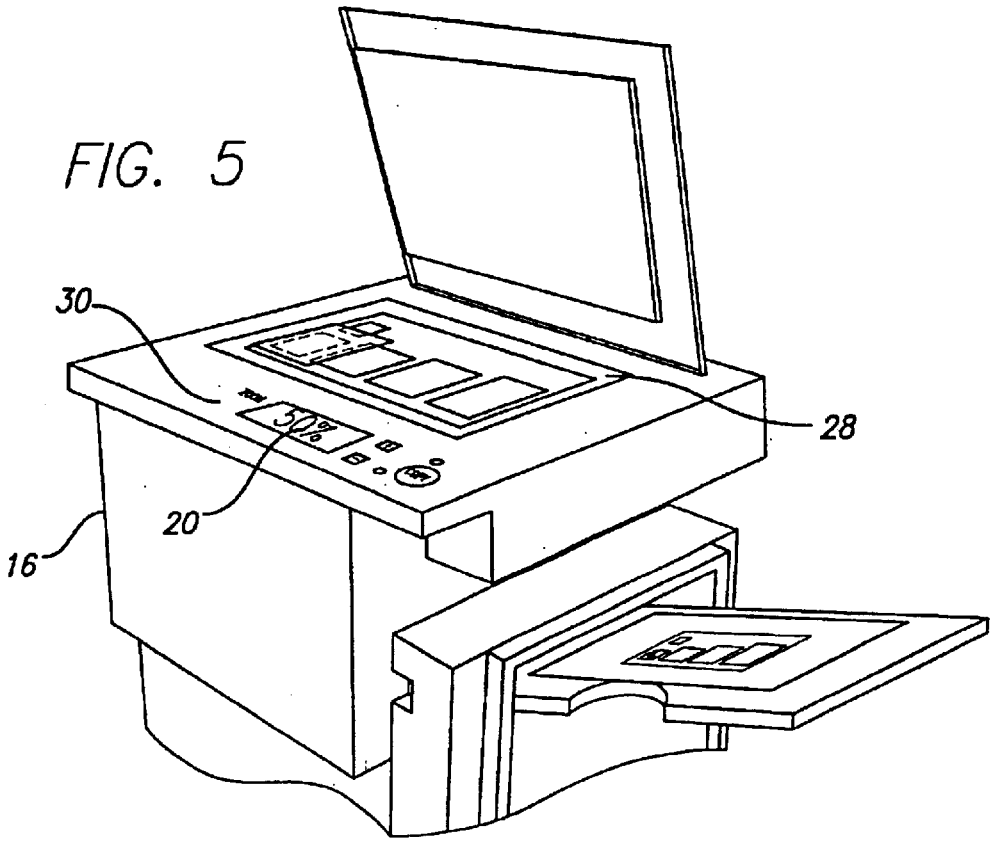
FIG. 5 is a diagrammatic view illustrating the device and method of the present invention employed in placing a second cropped photograph on the photocopy machine set to the 50% zoom or reduction setting corresponding to the 50% setting of the template.
Figure 6:
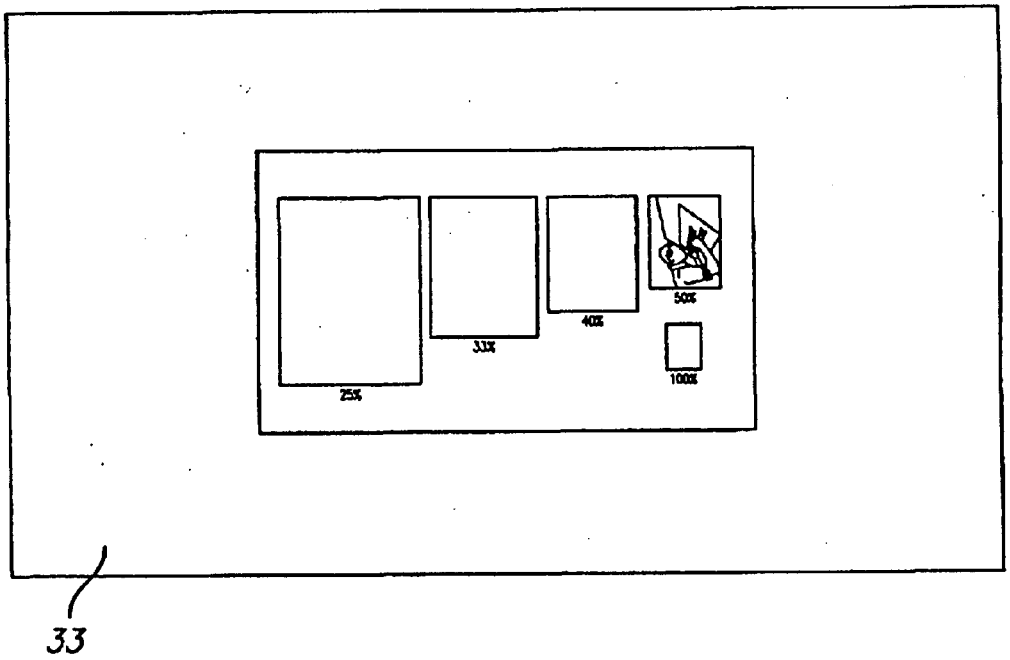
FIG. 6 is a diagrammatic view illustrating one of the photographic images duplicated onto photocopy paper after undergoing the reduction phase in accordance with the present invention.
Figure 7:
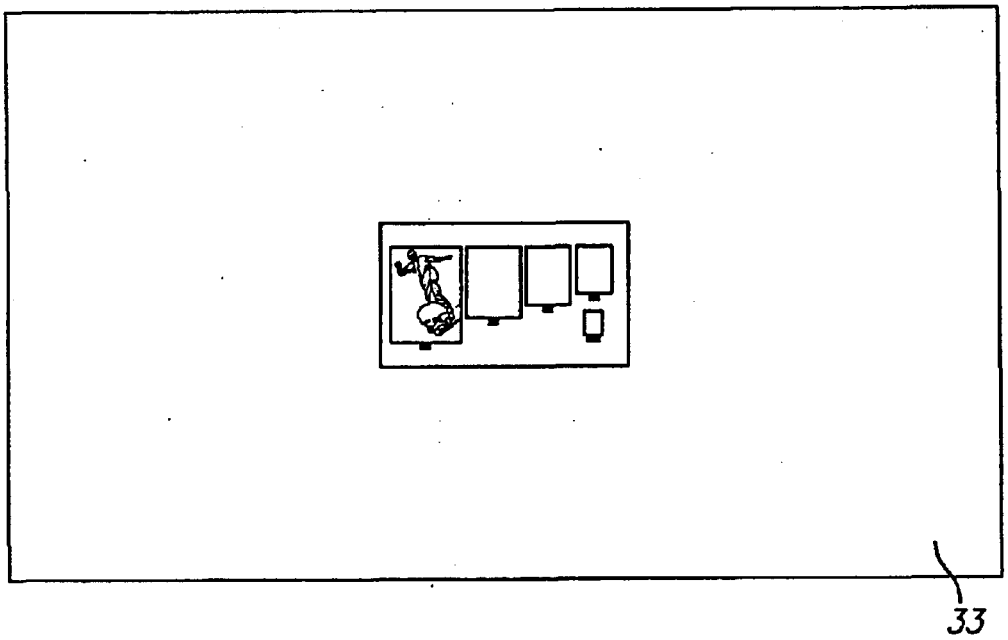
FIG. 7 is a diagrammatic view illustrating a different photographic image duplicated onto photocopy paper after undergoing the reduction phase in accordance with the present invention.
Figure 9:
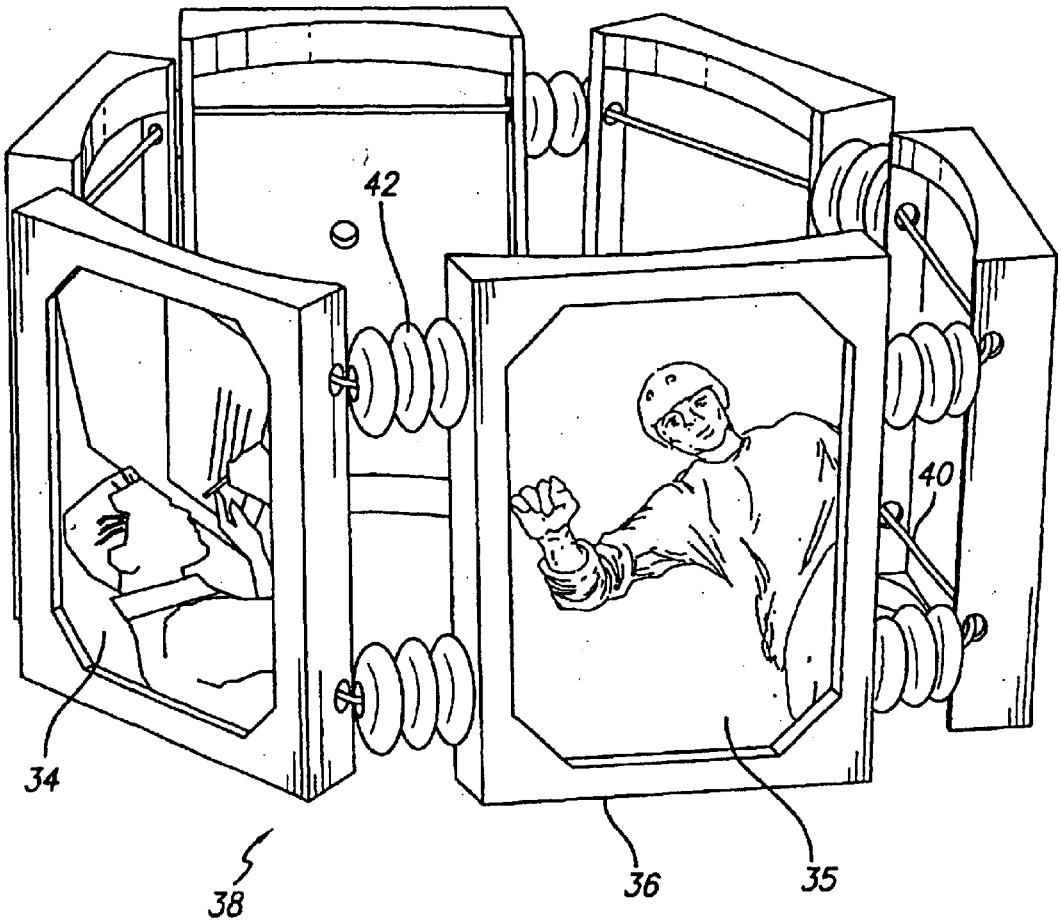
FIG. 9 is a perspective view illustrating the cropped photographic images positioned inside the miniature frames of the article of jewelry.

Referring more particularly to the drawings, FIGS. 1A and 1B are perspective views of template group 10A and template group 10B in accordance with the present invention. Template group 10A, which can comprise a rectangular sheet of reinforced paper or plastic, or some other suitable material, includes individual templates a, b, c, d and e with size or zoom settings 12 associated with each template and corresponding to reduction or zoom settings 14 on photocopy machine 16. Template group 10B comprises individual templates f, g, h, i and j with size or zoom settings 18 associated with each template and corresponding to reduction or zoom settings 20 on photocopy machine 16.

Each template from template group 10A and 10B is sized to a different scale relative to the other templates in the group, and is defined by a border 22. An individual template, e.g., template a or b from template group 10A, is provided to overly a photograph 24 in order to crop the desired portion of the photo image 26.

For example, in FIG. 2A, image 26 of photograph 24 is reduced in size by placing template a (25% reduction) over photograph 24 and manipulating border 22 to crop the desired smaller image. For progressively smaller image portions of the same photograph 24, templates b, c, d ore may be utilized. The same idea and method applies to template group 10B and the individual templates f through h therein.

A conventional photocopy machine 16 is provided to work in combination with the cropped images to achieve the intended objective, which is to reduce the dimensions of all the images, irrespective of the original size of the desired photo image, to a standard size to enable the image(s) to be assembled and properly integrated with certain components of an article of jewelry, such as miniature frame(s) 36.

Accordingly, a template, for example, a, b, and/or c, etc., individually overlays a single photograph 24 and is manipulated, using borders 22 as a guide, to determine the size parameters of the desired image 26.

The cropped image 26, which can be secured to the templates a, b, c, etc. by tape or any suitable adhesive (not shown), is placed face down on the transparent support or glass portion 28 of photocopy machine 16. The reduction or zoom settings 30 are then selected according to the settings 12 or 18 corresponding to the individual template utilized to crop the photograph. Thus, for example, using template a to crop photograph 24 to produce a smaller image 26, the reduction or zoom settings 30 on photocopy machine 16 are set to reduction setting 14, or 25%, corresponding to the setting 12 of template a.

When the cropped photo image is reduced to the desired size, any suitable sharp instrument, such as scissors 32, may be utilized to cut the image from photocopy paper 33 to its exact borders (FIG. 8). The resulting images 34 and 35 are then placed within similarly sized miniature frames 36 by any suitable means, and secured.

Miniature frames 36 are employed, typically in a series, as components of an article of jewelry, such as bracelet 38, strung together using resilient wire, thread or any suitable synthetic cord 40. Baubles or beads 42 may also be combined with the other components to enhance the bracelet's aesthetic appearance.

There are various alternatives in employing the device of the present invention, including using the same photograph to produce a variety of images. For example, using photograph 24 depicted in FIG. 2A, a full image 26 can be produced by cropping photograph 24, as shown. FIG. 2B depicts cropping the same photograph using template d to produce a more confined image primarily encompassing the upper torso and head of the subject. Using template e to crop photograph 24 would likely produce an image only of the subject's head.

When all these individually cropped images are placed on photocopy machine 16, and duplicated according to the present invention, the result is three different images of exactly the same dimensions enabling them all to fit properly within identically sized miniature frames of an article of jewelry.

The method of the present invention comprises utilizing template group 10A, more precisely one or more of the individual templates a, b, c, d, etc., therein, to reduce and standardize the size(s) of a visual work, such as image 26 of photograph 24, for use in combination with an article of jewelry.

The steps of the method include selecting one or more of the individual templates (e.g., a, b, c, etc. or f, g, h, etc.) according to the size and focus of the image desired to enable the image(s) to be placed within one or more of the miniature frames 36 of the article of jewelry. The appropriately sized template is then placed over the photograph 24 and manipulated into position to crop the desired image. Using the zoom setting indicated with each template as a reference, the corresponding zoom or reduction setting is selected on photocopy machine 16, and the image, overlayed by the template, is duplicated and reduced in size according to a requisite standard specifications.

The resultant image is then separated from the photocopy paper 33 using any suitably sharp instrument, such as scissors 32, and placed securely within the size compatible miniature frame 36.

Typically, images cropped from several photographs are utilized in accordance with the present invention to achieve the requisite assortment of images necessary to complete and enhance the appearance of the miniature frames 36 and the article of jewelry in particular.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

What is claimed is:

1. A device employed in the reduction of visual works of varying dimensions for use with an article of jewelry having a series of attached miniature picture frames, comprising:

a rectangular sheet of material, said material having a plurality of different size openings defined by borders adapted to overlay the largest version of one or more of said visual works to overlaying progressively smaller cropped versions of said visual works; and, means to create a series of said visual works of uniform dimensions from said visual works having varying dimensions to enable each of said visual works to fit within a corresponding similarly sized said miniature picture frame.

2. The device of claim 1 wherein said means combined with said overlayed visual works to standardized the dimensions of said visual works comprises a photocopy machine having the means to reduce the sizes of said visual works according to a predetermined photo reduction setting corresponding to each of said openings.

3. The device of claim 2 wherein each of said different size openings corresponds to a predetermined setting in said photocopy machine, each said individual setting being identified adjacent to each of said openings.

4. A device employed in the reduction of visual works of varying dimensions for use with an article of jewelry having a series of attached miniature picture frames, comprising:

a rectangular sheet of material, said rectangular sheet having a plurality of rectangular openings each differing in height and width, said openings being defined by borders, with the largest of said bordered openings adapted to overlay the largest version of one or more of said visual works and the progressively smaller bordered openings adapted to overlay proportionally smaller cropped versions of said visual works; and, means combined with said overlayed visual works to standardize the dimensions of said visual works to enable said visual works to be uniformly dimensioned and integrate and fit within a corresponding similarly sized said miniature picture frame.

5. A method of employing a device having a plurality of different dimensioned openings to reduce and uniformly size visual works with images thereon for use in combination with an article of jewelry having a series of miniature picture frames, comprising the steps of:

a) selecting one of said openings according to the size required to crop a desired image;

b) positioning said opening to overlay said visual work and crop a desired image;

c) indicating a setting on a photocopy machine to enable the reduction of the size of the image according to a setting indicator associated with each said opening;

d) positioning the cropped image on the photocopy machine;

e) activating the photocopy machine to reduce and uniformly size the image;

f) separating the image from the photocopy paper; and g) assembling and integrating each of said images with a corresponding said miniature picture frame.

6. The method of claim 5 wherein one or more of said images is assembled and integrated with said miniature picture frames attached to form a bracelet.

* * * * *